US010508396B2

(12) United States Patent
Kullberg

(10) Patent No.: US 10,508,396 B2
(45) Date of Patent: Dec. 17, 2019

(54) WATER BARRIER ELEMENT

(71) Applicant: Sten-Magnus Kullberg, Linköping (SE)

(72) Inventor: Sten-Magnus Kullberg, Linköping (SE)

( * ) Notice: Subject to any disclaimer, the term of this patent is extended or adjusted under 35 U.S.C. 154(b) by 0 days.

(21) Appl. No.: 15/766,969

(22) PCT Filed: Oct. 7, 2016

(86) PCT No.: PCT/SE2016/000053
§ 371 (c)(1),
(2) Date: Apr. 9, 2018

(87) PCT Pub. No.: WO2017/061918
PCT Pub. Date: Apr. 13, 2017

(65) Prior Publication Data

US 2018/0298575 A1 Oct. 18, 2018

(30) Foreign Application Priority Data

Oct. 7, 2015 (SE) ..... 1500403

(51) Int. Cl.
*E02B 3/10* (2006.01)

(52) U.S. Cl.
CPC ..... *E02B 3/106* (2013.01)

(58) Field of Classification Search
CPC ... E02B 3/106; E02B 3/04; E02B 3/10; E06B 2009/005
USPC ..... 405/90, 102, 107, 112, 114
See application file for complete search history.

(56) References Cited

U.S. PATENT DOCUMENTS 5,487,244 A * 1/1996 Hill ..... E06B 9/02 49/57
5,653,349 A 8/1997 Dana et al.
6,079,904 A * 6/2000 Trisl ..... E02B 3/106 405/107
6,132,140 A * 10/2000 Kullberg ..... E02B 7/22 405/114
6,840,711 B1 * 1/2005 Martinez ..... E02B 3/106 405/107

(Continued)

FOREIGN PATENT DOCUMENTS

DE 88 08 124 U1 10/1988
DE 203 08 090 U1 12/2003

(Continued)

OTHER PUBLICATIONS

International Search Report and Written Opinion for corresponding Patent Application No. PCT/SE2016/000053 dated Jan. 27, 2017.

(Continued)

*Primary Examiner* — Carib A Oquendo
(74) *Attorney, Agent, or Firm* — Renner, Otto, Boisselle & Sklar, LLP

(57) ABSTRACT

Barrier element for connection to a water barrier covered with a membrane, in particular for water barriers, and comprising inclined supports and inclined barrier panels (5) supported thereon. The barrier panels (5) are a distance down from the top edge bent so that the top part when mounted on the inclined support become more upright or even vertical and that the support and the lower part of the panel are inclined less than 45 degrees relative the round.

6 Claims, 4 Drawing Sheets

(56) References Cited

U.S. PATENT DOCUMENTS

| | | | | |
|---|---|---|---|---|
| 2004/0265063 | A1* | 12/2004 | Kullberg | E02B 3/106 405/107 |
| 2010/0329785 | A1* | 12/2010 | Nero | E06B 3/9642 405/16 |
| 2012/0230768 | A1* | 9/2012 | Rowland | E02B 3/106 405/114 |

FOREIGN PATENT DOCUMENTS

| | | | |
|---|---|---|---|
| DE | 20306165 | U1 | 12/2003 |
| DE | 102 37 068 | A1 | 2/2004 |
| DE | 10 2005 002 485 | A1 | 8/2006 |
| SE | 9502817-1 | | 4/1998 |
| WO | 97/07290 | | 2/1997 |
| WO | 2004/025033 | A1 | 3/2004 |

OTHER PUBLICATIONS

Extended European Search Report for corresponding European Patent Application No. 16853985.6 dated Jun. 13, 2019.

* cited by examiner 4
6
5
2
7
4
3
37,9°
739,35
1020
1200
1
4

6
5
5
3
7
1

WATER BARRIER ELEMENT

This application is a national phase of International Application No. PCT/SE2016/000053 filed Oct. 7, 2016 and published in the English language, which claims priority to Swedish Patent Application No. 1500403-9 filed Oct. 7, 2015, which are hereby incorporated herein by reference.

BACKGROUND OF THE INVENTION

In order to prevent flooding of rivers it is known to build walls, this is however always an economic decision and sooner or later the water level can get too high, or appear at an unexpected location. The old remedy is sandbags, which require much work and uncertain result. Different mechanical solutions have been suggested and one of the more successful developments is described in the Swedish patent SE9502817-1 where use is made of loading pallets, a triangular support structures and a covering plastic membrane. An important feature of this water barrier is that the surface facing the water is inclined 45 degrees which cause the contact pressure against the ground to be the same as the pressure with which the water try to push away the barrier. In other words a good grip in the ground can be achieved.

Since loading pallets are present in great numbers almost everywhere in Europe barriers can be achieved more rapidly and with less work with better results than sandbags. In countries outside of Europe instead steel panels have been used due to the lack of loading pallets.

Overflowing seas and rivers however remains a problem that seems to increase, consequently lighter barrier elements are desired as well as barriers that can be used in various situations and as easily as possible.

BRIEF SUMMARY OF THE INVENTION

The above problem is in accordance with the invention solved with an inclined support structure and on this an inclined panel constituting part of a barrier surface is supported. The panel has a lower part intended to be inclined relative the ground, and an upper part that that is intended to be more or less vertical with an intermediate bend extending essentially perpendicular and horizontal across the panel.

Since the upper part of the panel is vertical an increase in height is achieved. Also the support can be made shorter since it will not be in contact with the vertical part of the panel. This of course also reduce the down force on the support and the ground, in other words the grip of the barrier on the ground. Instead of using sandbags or other time consuming measures and constructions the loss of down force can according to a further development of the invention be compensated by a shaping of the panels.

The bend in the panels are simply made smaller than the 135 degrees that correspond to 45 degree inclination commonly used at this type of barriers. In this way there will be more water over the angled part of the panel. This means that the effective panel height that had been gained by making the upper end vertical can be reduced by choosing an appropriate angle. However this loss of height required to reinstate the down force is rather small as compared with the gain in height from the vertical upper end.

The result of the above is that the total height of the barrier can be increased and the size of the support structure can be reduced. The bend will reinforce the panel considerably and it will no longer be necessary with any extra support behind the barrier panel. Furthermore a vertical upper part of the barrier will reduce the risk of fast moving water splashing over the upper edge of the panel.

If the panel is made of a material with increased tensile strength, for instance high tensile steel, the weight of the panel can also be reduced. In order to counteract additional lateral pressure in the top of the panel the part of the supporting structure that is in contact with the ground can be extended away from the water to prevent tilting backwards.

In a further development of the invention the panels are connected to the supports by one keyhole connection at each side of the panels. Preferably comprising inverted keyhole openings in the inclined parts of the panels, in the height wise middle thereof or in de height wise middle of the panel or so. In the upper member of the support there is a bolt or protrusion with an enlarged knob or head at a corresponding location. Proximate panels us a common substrate and bolt. When the first panel is applied on a bigheaded protrusion the panel can simply slide down letting the head of the protrusion enter into the large part of the key hole and then the panel slide on with the head or knob passing up on the backside of the panel along the narrow part of the inverted keyhole. At the same time the lower end of the panel slide into an upwards turned lower end of the support top beam. When we come to the second panel that is identical to the first it cannot just be slide down into the key hole because the angle of the first panel will prevent it from being laid flat on first panel. However forcing of the panels to flex, lifting of the first panel or a lateral angling of the second panel can allow the second panel also to become locked below the bigheaded protrusion. In other words a time saving fast and reliable locking is obtained.

BRIEF DESCRIPTION OF THE DRAWINGS

Further characteristics and advantages are apparent from the sub claims and the following description with reference to the drawings.

In the drawings

DETAILED DESCRIPTION OF THE INVENTION

Figure 1:
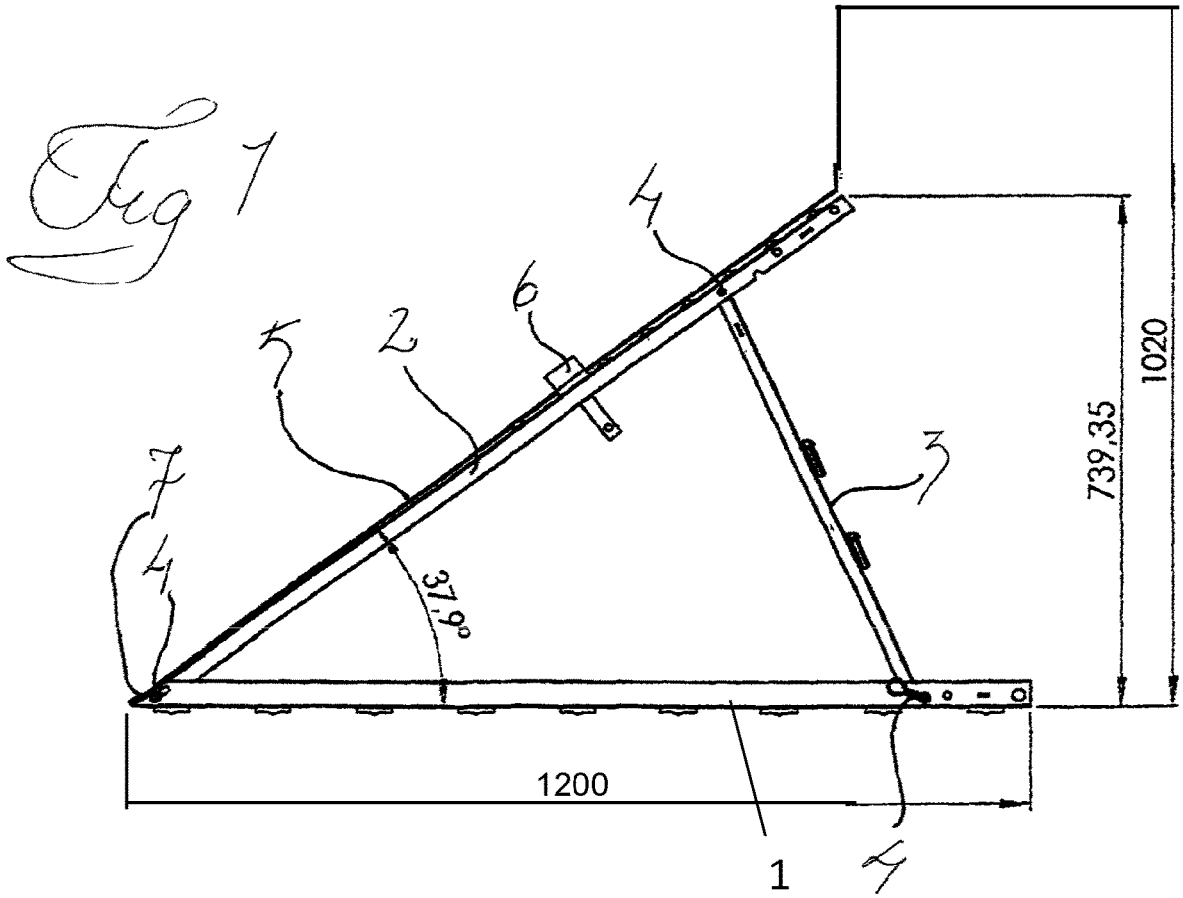
FIG. 1 depicts a barrier element seen from the side in a first use, FIG. 2 a perspective the view of two such barrier elements, FIG. 3 a second use of the same barrier panel, FIG. 4 yet another use of the panel element and FIG. 5 another view of a panel.
Figure 2:
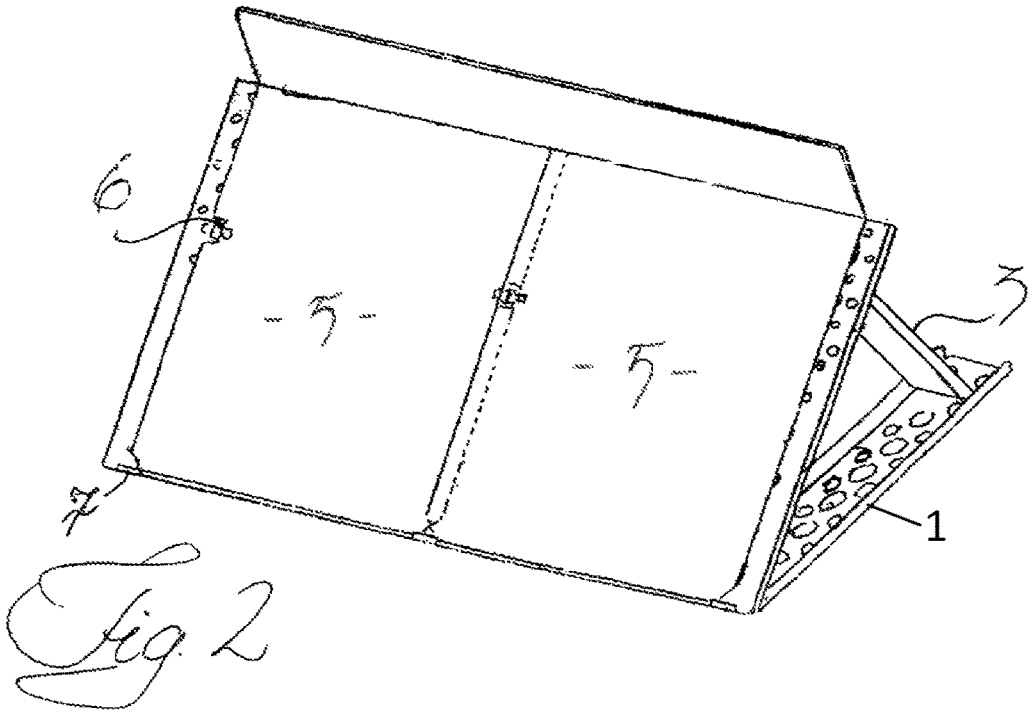
Figure 2:
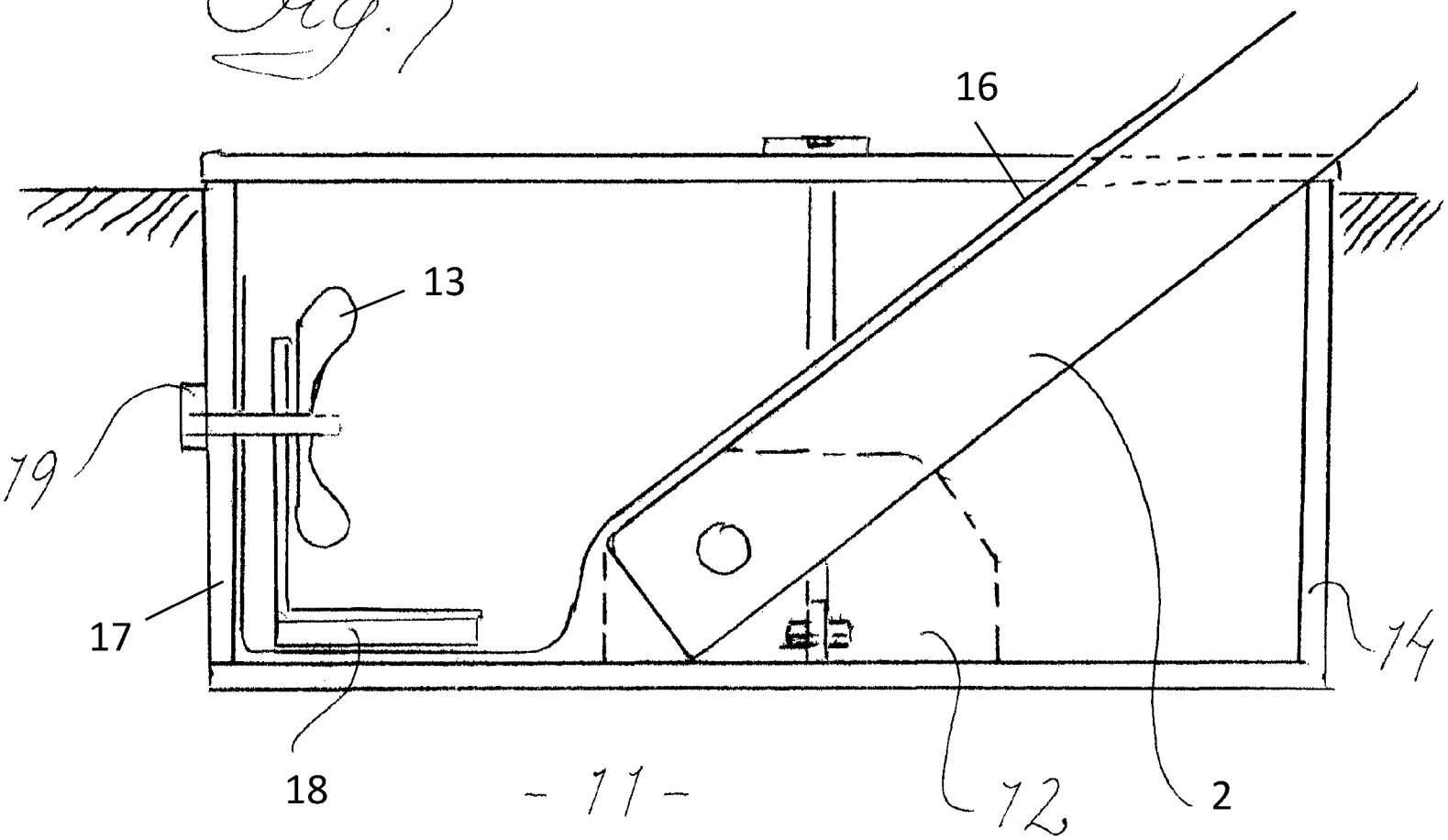

The water barrier element, shown in FIG. 1, comprise a triangular support structure constituted by three U-shaped beams. A bottom beam 1 is horizontal and is in the pointed end of the support joined to an inclined beam 2 and these two beams are in their other ends connected with a connecting beam 3. The beams are joined by three bolts 4 extending through holes in the beam flanges. The beams are made of sheet metal. The bottom beam, horizontal, is provided with protrusions downwards to increase the grip in the ground.

The inclined, top beam has its flanges facing downwards. In the lower end of the inclined beam the sheet metal is first bent up and then bent again parallel (U-bent) with the beam with an intermediate distance to this that is slightly more than the double thickness of a panel. A distance further up on the inclined beam a protrusion 6 extends upwards, and has a length a little longer than the thickness of two panels, ending with a latterly enlarged head or knob.

An angled barrier panel 5, which is to be a part of the barrier surface, is provided with inverted key holes at the sides that can cooperate with the round-headed protrusions on the inclined beams and the U-bent lower ends 7 thereof so that each barrier panel is to be connected with two proximate triangular support structures. In this way the barrier panels 5 overlap at the supports and provide together with the bolts or protrusions a continuous connecting chain. Finally a sealing membrane is placed over the barrier panels.

When the first panel is applied on a bigheaded protrusion the panel can simply slide down letting the head of the protrusion enter into the large part of the key hole and then the panel slide on with the head or knob passing up on the backside of the panel along the narrow part of the inverted keyhole. At the same time the lower end of the panel slide into the upwards turned lower end of the top beam. When we come to the second panel that is identical to the first cannot just be slid down into the key hole because the angle of the first panel will prevent it from being laid flat on first panel. However forcing of the panels to flex, lifting of the first panel or a lateral angling of the second panel can allow the second panel also to become locked on the bigheaded protrusion. In other words a time saving fast locking or dismantling is obtained.

The inclined beams of the supports need not to extend further up than to the bend in the barrier panel 5 and thus the support can be correspondingly shorter and lighter.

Sometimes there is need for a higher barrier and then a higher support structure can be used on which a lower flat barrier panel can be used at the bottom and with an angled top barrier panel as described above. All panels can be fastened with the above key-hole-principle. One can also start with a flat panel on a normal support and then if the water continues to rise complement it with loose structure parts and an angled panel.

At some locations a brick or concrete wall 11 is built along a river bed to take care of normal high water conditions, but when conditions become extreme it can become necessary to increase the height. This can also be done with the invention. When making the wall a U-shaped metal channel 14 is encased into the top of the wall. At regular intervals internal cross wise arranged holes provided pairs of ears are welded fast in the channel. The distance between the pairs of ears coincide with the distance between the keyholes in the top structure panel and the distance between the ears in each pair of ears is slightly more or less than the width of the top inclined beam permitting the lower tip 12 of the top inclined structural beam to be fastened in the U-shaped channel. If the U-shaped beam is sufficiently well anchored in the wall and the inclined beam is sufficiently strong no additional structure beams may be needed, the inclined beam can simply rest against the inner top flange of the channel that has been given a sufficient height to provide the desired angle.

Additional holes are arranged in the inclined beam for the connection of the bottom beam and connecting beam for additional support if needed and with the same inclination. If time is short you can at least start with the inclined beam resting on the edge of the U-shaped beam, and you mount the panel and membrane. Then you mount horizontal and connecting beams so that the inclined beam as well as the panel also rest on the wall, since all these and there joints are accessible from the landside of the wall.

The sealing covering membrane 16 can at the front of the U-shaped metal channel be clamped to the front vertical flange 17 by an angle iron 18 and a number of welded bolts 19 and wing nuts 13.

When there is no barrier elements mounted in the top of the wall the U-shaped channel can be closed with a lid or long strip to prevent it from being clogged with leaves or people from being injured on the ears and other elements inside the channel.

Figure 4:
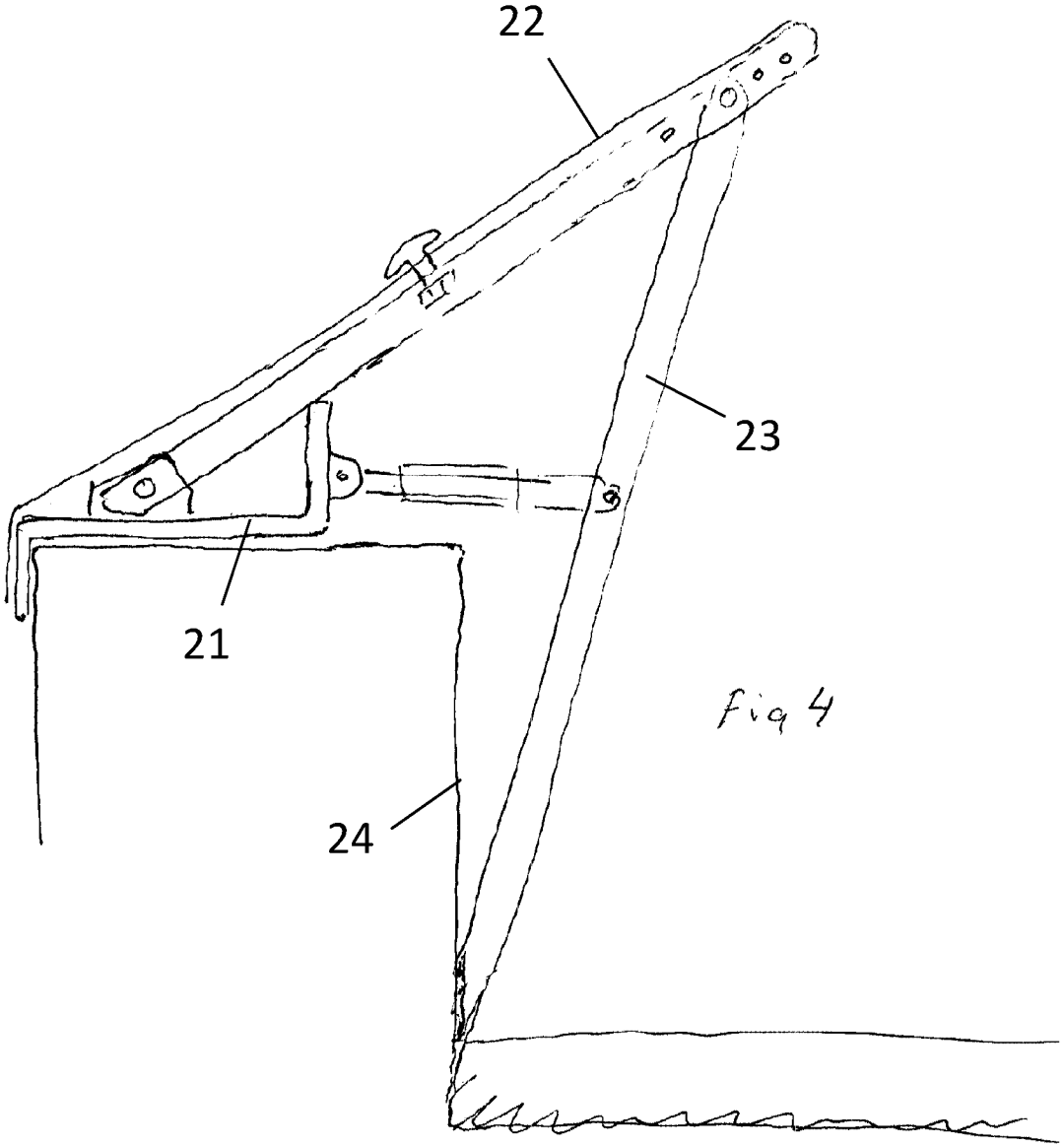
Figure 5:
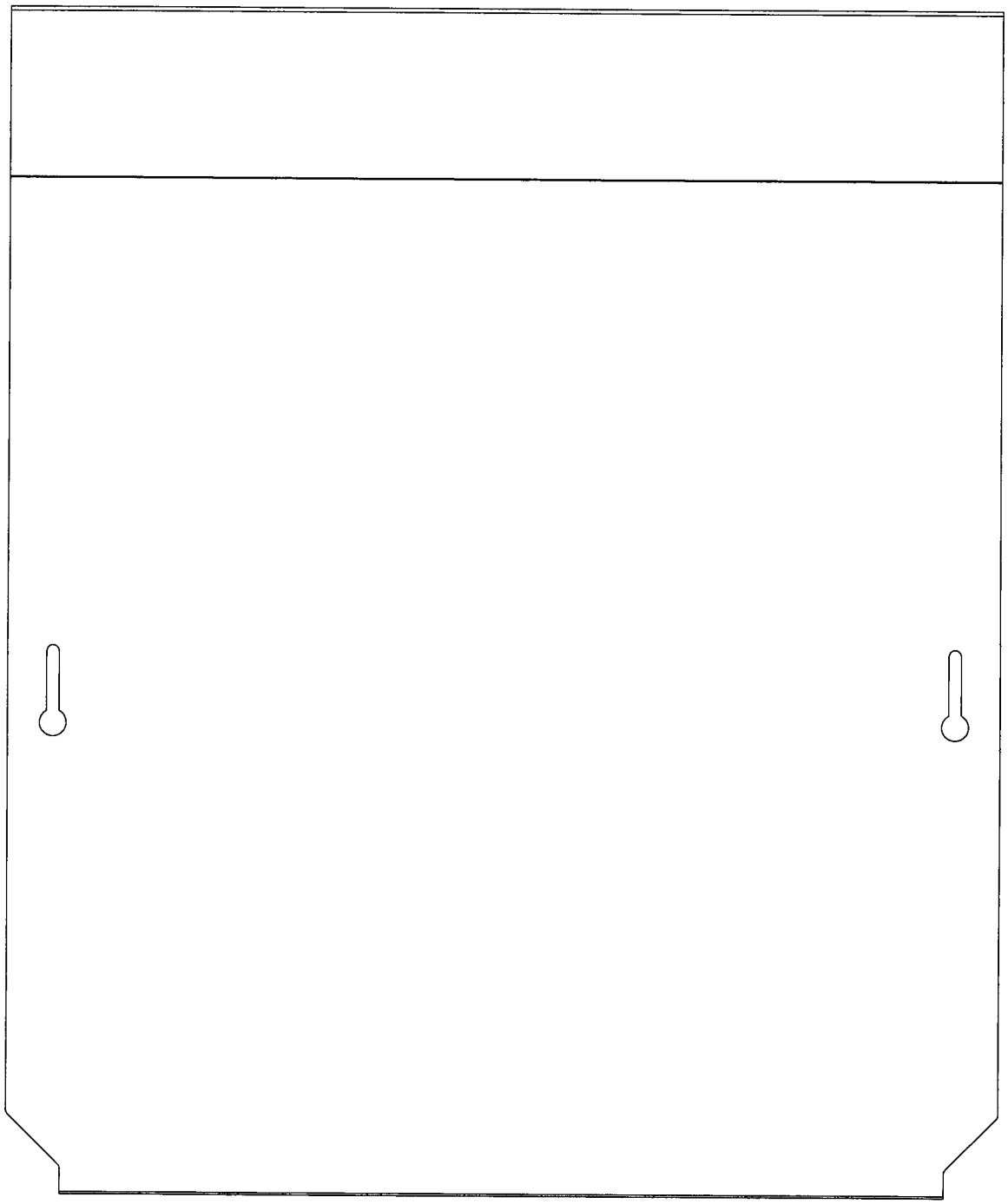

In case that there already exist a wall but without a built in channel a Z-shaped profile iron 21 can be used as shown in FIG. 4 instead of the built in channel. Here however the angled or bent panel 22 has been turned upside down as well as the key hole. However the keyhole can be double and with the round hole in the middle. Here the panel hangs in a vertical beam 23 on the backside as can also an additional panel. The vertical beam 23 is fastened to the vertical and inclined support beams and in contact with the wall 24, provided of course that the wall is strong enough. The same principle can of course also be used together with the encased U-shaped beam.

The invention claimed is:

1. A water barrier for connection in a chain of water barriers, the water barrier comprising inclined supports and inclined barrier panels supported thereon, wherein the barrier panels are made of high tensile steel and are bent a distance down from a top edge of the barrier panels so that a top part of the barrier panels, when mounted on the inclined support, become more upright than a lower part of the barrier panels or even vertical, wherein the barrier panels are connected to the inclined supports by at least one keyhole opening close to each side edge of the lower part of the barrier panel and corresponding protrusions with enlarged knobs on the inclined supports, wherein the enlarged knobs are insertable into a larger part of the keyholes that is wider than a narrower part of the keyholes along which the protrusions are movable, wherein the protrusions have a length at least twice a thickness of the panels permitting adjoining proximate barrier panels to overlap and share protrusions and enlarged knobs, and wherein the inclined supports in their lower ends are U-shaped in order to grip over a lower edge portion of the barrier panels.

2. The water barrier according to claim 1, wherein the inclined support and a lower part of the barrier panel are inclined less than 45 degrees relative a ground.

3. The water barrier according to claim 2, wherein the at least one key hole opening are arranged essentially halfway between the top edge and a bottom edge of the respective barrier panels.

4. The water barrier according to claim 1, wherein the inclined supports comprise an upper member on which the barrier panels rest and a bottom member for contact with a ground or other substrate, said upper and bottom members are U-shaped with a relatively wide middle part and relatively low flanges facing each other, wherein the wide middle part of the upper member is wider than the wide middle part of the bottom member so that it can grip over the bottom member, wherein holes are provided in the flanges so that a bolt through the holes can join the upper and bottom members in the ends facing the water, wherein the flanges of the upper member also have holes so that the upper and bottom members can be joined with the upper member protruding down below the bottom member for fastening in brackets prearranged in the ground, a wall top or other substrate.

5. The water barrier according to claim 4, wherein the brackets are arranged in a metal channel in the wall top or in the ground.

6. The water barrier according to claim 1 wherein the barrier panel is angled less than 135 degrees.

* * * * *